United States Patent [19]

Bottom

[11] Patent Number: 4,694,876

[45] Date of Patent: Sep. 22, 1987

[54] KNOCK-DOWN ADJUSTABLE AWNING CONSTRUCTION

[75] Inventor: Michael T. Bottom, Crawford County, Mo.

[73] Assignee: T. J. Bottom Industries, Inc., Cuba, Mo.

[21] Appl. No.: 744,632

[22] Filed: Jun. 14, 1985

[51] Int. Cl.[4] ..... E04F 10/00

[52] U.S. Cl. ..... 160/45; 135/89

[58] Field of Search ..... 160/45, 46, 47; 135/89, 135/106

[56] References Cited

U.S. PATENT DOCUMENTS

| | | | |
|---|---|---|---|
| 2,787,321 | 4/1957 | Dietz | 160/47 |
| 3,010,463 | 11/1961 | Wade | 135/106 |
| 3,720,438 | 3/1973 | Johnson et al. | 160/46 |
| 3,826,271 | 7/1974 | Sattler et al. | 135/89 |
| 3,923,074 | 12/1975 | McKee | 135/89 |

FOREIGN PATENT DOCUMENTS

| | | | |
|---|---|---|---|
| 2603738 | 8/1977 | Fed. Rep. of Germany | 110/45 |

*Primary Examiner*—Ramon S. Britts
*Assistant Examiner*—Cherney S. Lieberman
*Attorney, Agent, or Firm*—Kalish & Gilster

[57] ABSTRACT

A knock-down awning construction which comprises an upper mounting strip and a lower transverse arm, each having tubular portions, a curtain with the upper end thereof detachably but reliably engagable within the tubular portion of the mounting strip. The lower portion of the curtain is detachably but lengthwise adjustably receivable within the tubular portion of the lower transverse arm; there being pivotally mounted return arms interconnecting the lower transverse arm and the awning support surface. A manually controlled flexible elongated member is provided for swinging the awning between downward or operative condition and upward or inoperative condition.

2 Claims, 10 Drawing Figures

FIG. 5
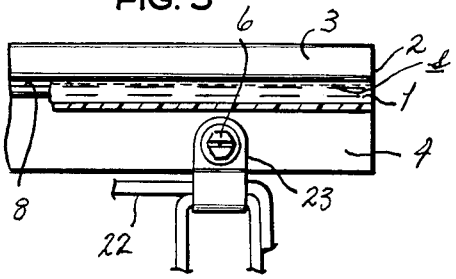
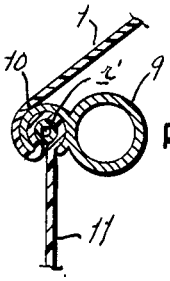
FIG. 4
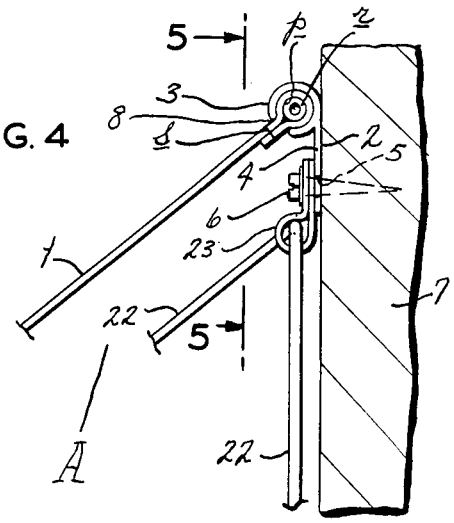
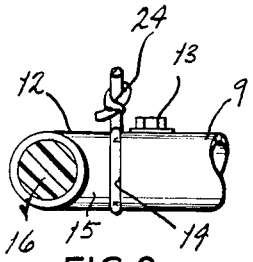
FIG. 6
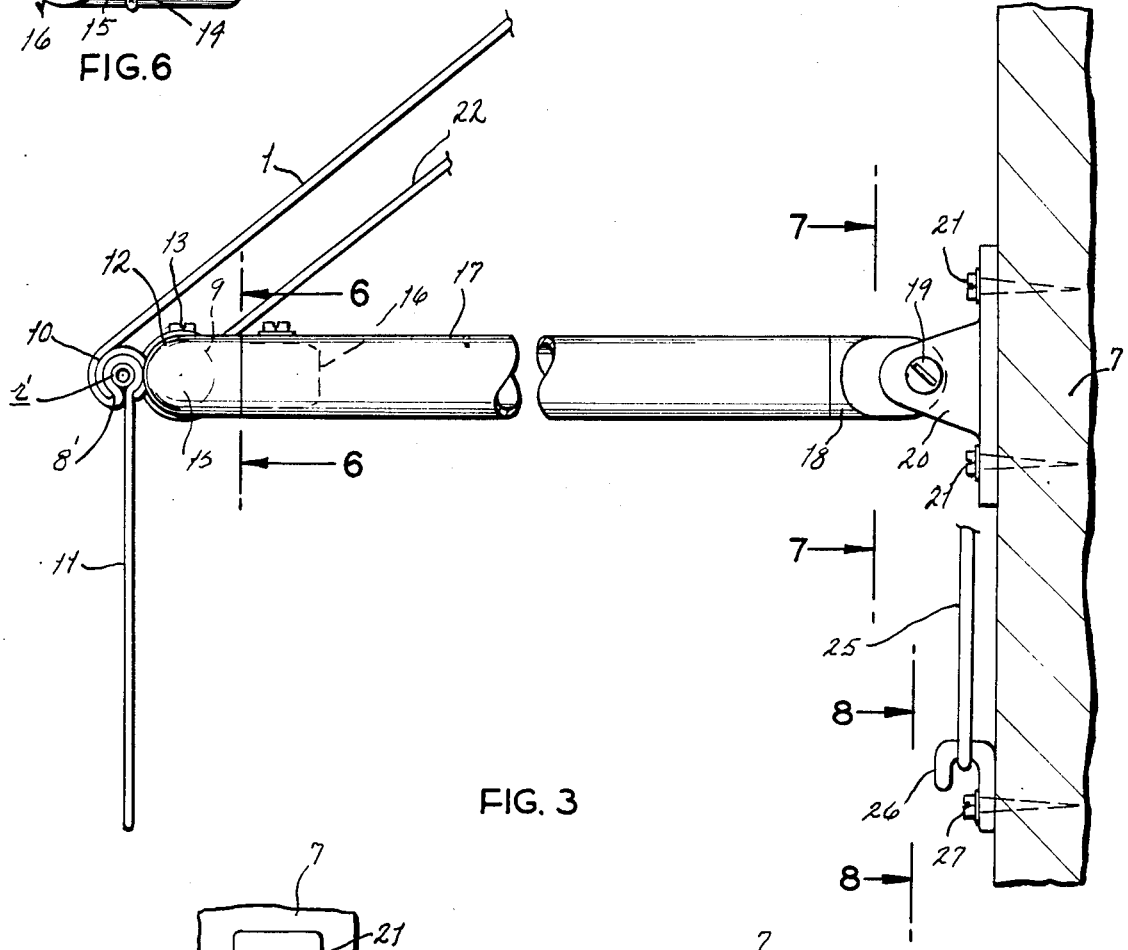
FIG. 3
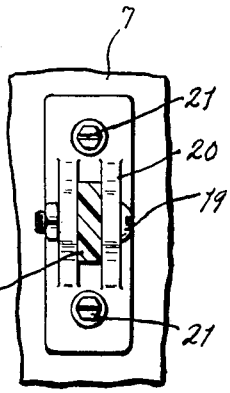
FIG. 7
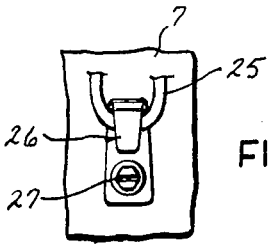
FIG. 8

KNOCK-DOWN ADJUSTABLE AWNING CONSTRUCTION

BACKGROUND AND SUMMARY OF THE INVENTION

This invention relates to a building window and door treatment and, more partcularly, to a certain new and useful invention in a knock-down adjustable awning and canopy construction therefor.

Heretofore awning and canopy constructions for buildings have historically been non-adjustable in usage so that the user must carefully determine the length of awning or canopy desired and then purchase same with such predetermined length. With great frequency, the user will discover too late that the length purchased just is not adequate so that replacement must be obtained without regard to the matters of ready availability, potential additional charges, and involvement of further time consumption by reason of dismantling the unsatisfactory units and effecting acquisition of the desired replacement.

Furthermore, with the incidence of ever increasing costs in connection with dwelling improvements, there has been a well developed need for awning constructions which may be assembled and installed by the average individual who may not possess the skill of an artisan.

Therefore, it is an object of the present invention to provide an awning construction which is comprised of a mulitplicity of discrete components so constructed and fabricated as to permit ready integration into an awning construction by the average unskilled individual.

It is another object of the present invention to provide an awning construction of the character stated being of knock-down character and comprised of readily assembled components which are of sturdy and extremely durable character and economically produced.

It is a further object of the present invention to provide an awning construction of the character stated which incorporates novel components adapted to permit a facile lengthwise adjustment of the curtain without the necessity of replacing the unit or effecting any severing of the curtain whereby the user may effectively adjust the curtain to any preselected length without the intervention of skilled services.

It is an additional object of the present invention to provide a knock-down awning of the character stated which is adapted for ready adjustment of the curtain length without the utilization of tools and which permits the user to alter the curtain length optionally from time to time.

It is another object of the present invention to provide an awning construction of the character stated being uniquely comprised of components which lend themselves to compact packaging when in knock-down state so as to create a manifest attractive package dress while concurrently being of a size permitting ease of transportability.

It is a still further object of the present invention to provide a construction of the character stated which would be economically produced; easily installed; and durable in usage.

DESCRIPTION OF THE DRAWINGS

FIG. 3 is a side elevational view, in partial section, taken on the line 3—3 of FIG. 2.

FIG. 4 is a fragmentary transverse vertical view taken on the line 4—4 of FIG. 2.

FIG. 5 is a fragmentary front view, in partial section, taken on the line 5—5 of FIG. 3.

FIG. 6 is a fragmentary view taken in partial section on the line 6—6 of FIG. 3.

FIG. 7 is a fragmentary vertical view taken in partial section on line 7—7 of FIG. 3.

FIG. 8 is a fragmentary front elevational view taken on the line 8—8 of FIG. 3.

DESCRIPTION OF THE PREFERRED EMBODIMENT

Figure 1:
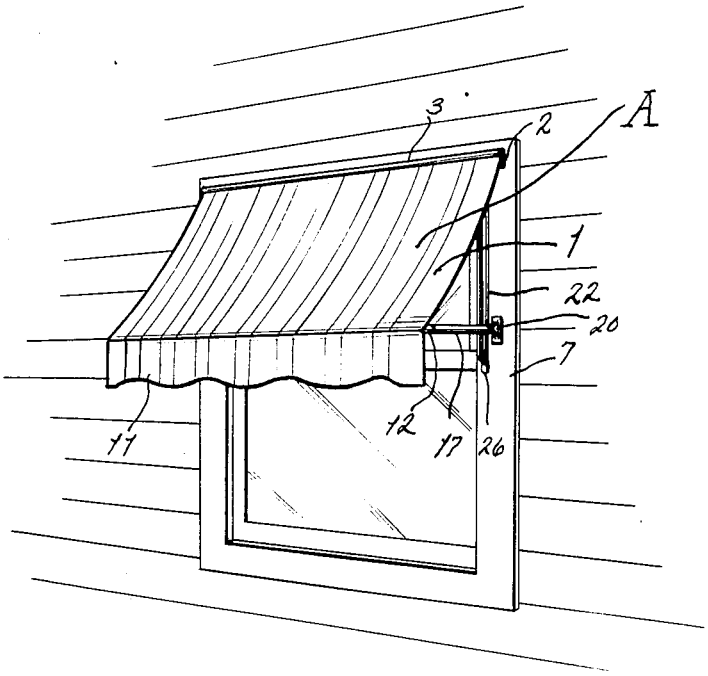
FIG. 1 is a perspective view of an awning constructed in accordance with and embodying the present invention illustrating the same in installed condition for window treatment.

Referring now by reference characters to the drawings which illustrate the preferred embodiment of the present invention, A generally designates an awning construction incorporating a curtain 1 of predetermined length and being fabricated of a coated yarn for rendering the same resistant to wear resulting from atmospheric changes and which is woven so as to be air permeable thereby allowing heat to rise away from the associated window. The upper end of curtain 1 is doubled upon itself and then stitched as at s to form a pocket p for receiving a coextensive elongated stiffening member r fabricated preferably of plastic and being desirably of tubular character for conducing to minimal weight of relative flexibility. Provided for engaging the upper end portion of curtain 1 is a mounting strip 2 as being formed of extruded aluminum or like material and which embodies an upper tubular section 3 and an integral depending lower plate 4. Said plate 4 is provided with a plurality of spaced apart openings 5 for extension therethrough of screws or like fastening elements 6 for securing the mounting strip 2 upon the wall 7 or other support of the structure involved. Coextensive with said tubular section 3 is a slot-like opening 8 in the lower forward quadrant thereof so as to open in a downwardly and outwardly direction with respect to wall 7.

The inside diameter of tubular section 3 snugly receives the upper pocket-containing end of curtain 1 with the member r received therein; said slot-like opening 8 being of such transverse extent as to permit the stitched portions of curtain 1 to extend therethrough but being substantially less than the diameter or cross section of member r so as to prevent any inadvertent displacement of the upper end of curtain 1. Thus curtain 1 progresses downwardly for disposition in shade providing or operative position or in upper, inoperative position, if desired, and as shown more fully hereinbelow.

The lower forward end portion of curtain 1 when in operative state extends downwardly over a front transverse arm 9 of tubular character and fabricated of aluminum or other lightweight durable, strong material and is thence turned upwardly for projection through a slot-like opening 8' provided in the lower, downwardly directed portion of a tube 10 integrally formed with, and forwardly of, transverse arm 9. Within said tube 10 curtain 1 is led about an elongated member r' of like construction as member r above described, and said curtain 1 thence progresses downwardly and outwardly through said opening 8' so that the lower end extent thereof, as at 11, may depend at a predetermined length.

The transverse extent of opening 8' is less than the diameter of member r' so that the portion of curtain 1 within tube 10 will not inadvertently or accidentally pass through opening 8'. Furthermore, the inside diameter of tube 10 is so related to the combined outer diameters of member r' and the portion of curtain 1 engaged thereabout so as to prevent any undesired slippage or relative movement of curtain 1 about member r' within tube 10 so that the preselected extent of the depending lower end 11 of curtain 1 is reliable against accidental alteration.

The inside diameter of arm 9 is greater than that of tube 10 and received within the ends of arm 9 are elbow fittings 12, 12', respectively, which may be of plastic construction and having openings for alignment with apertures in arm 9 to permit of securement by screws 13. With reference to FIG. 6, it will be seen that the central angular portion 15 of each elbow 12, 12' is diametrally increased so as to cause, in coordination with the location of the apertures for screws 13, the development of annular spacings 14, 14' between the angular portion 15 and the adjacent arm-received ends of elbows 12, 12' for purposes presently appearing. The opposite ends 16, 16' of elbows 12, 12' which extend returningly toward wall 7 are each accepted within the forward end of return arms indicated at 17, 17' (not shown). Each of said return arms 17, 17' is provided with an insertable eye-end 18 at its rearward end for effecting pivotal engagement as by a pin 19 within a hinge 20 secured as by screws 21 to wall 7, substantially downwardly of mounting strip 2. Thus by reason of the swingable character of return arms 17, 17' about their inner or rearward ends, the awning A of the present invention is thus adapted for disposition between operative or downward position as shown in FIG. 3 and upper, inoperative or collapsed condition upon upward swinging of said arms 17, 17'.

Figure 2:
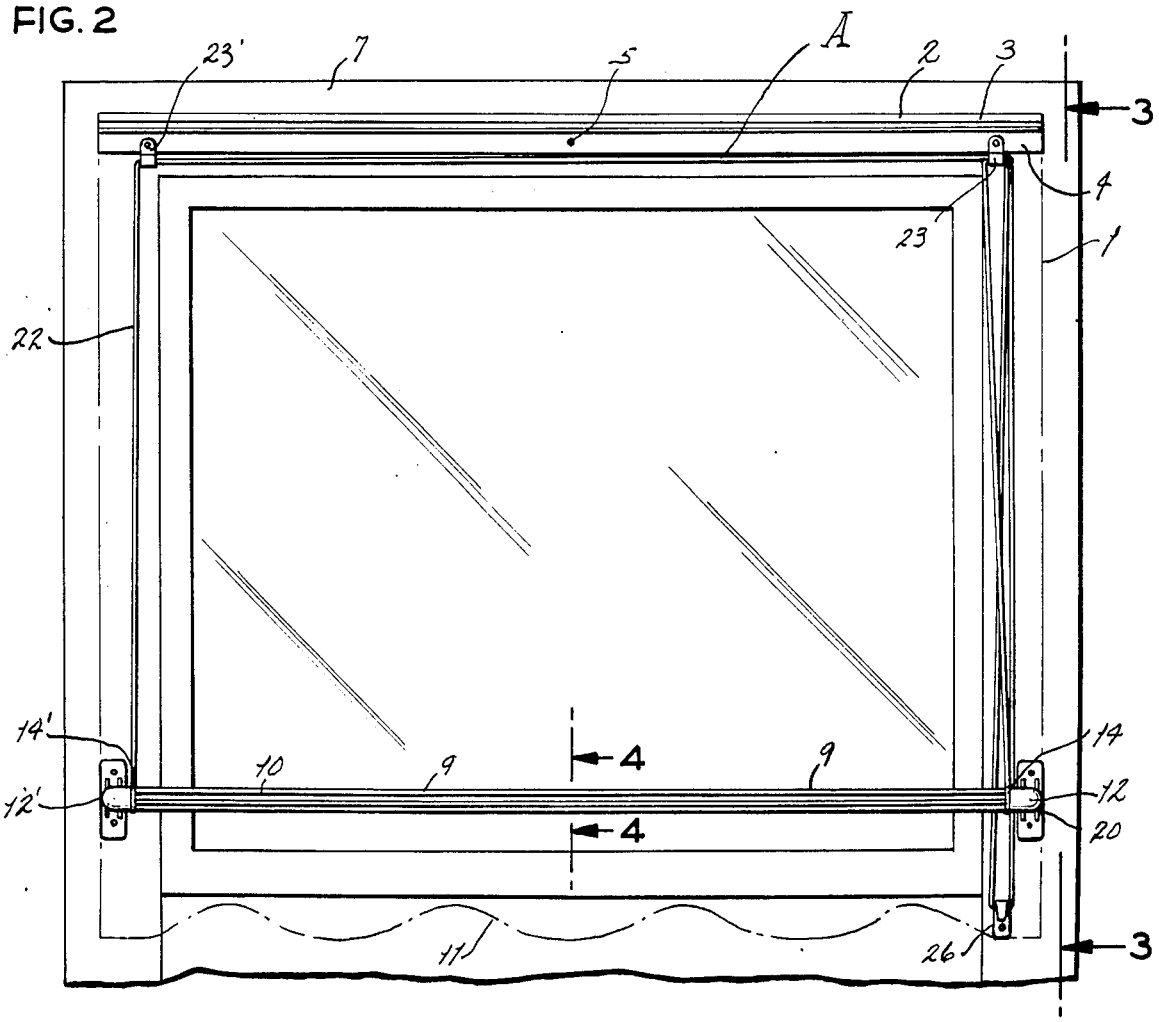
FIG. 2 is a front elevational view of the hardware components of the awning with the curtain therefor being illustrated in phantom lines.

In order to effect swinging movement of said awning A, there is provided a control rope 22, one end of which is received within the annular spacing 14' at the left hand end of transverse arm 9 as viewed in FIG. 2. Therefrom rope 22 is led upwardly for extension through rope guide 23 depending from mounting strip 2 adjacent its proximate end and being fixed as to wall 7 by screw 6. From guide 23 rope 22 extends transversely for extension through a companion guide 23' depending from the opposite end portion of mounting strip 2 (FIG. 5). Rope 22 projects downwardly from guide 23' and is of such length that the end thereof is threaded reversely through guide 23' and therefrom directed for securement of such free end within the annular spacing 14 as at 24 (see FIG. 3) adjacent the end of transverse arm 9 as at the right hand side of FIG. 2. The doubled portion of rope 22 will thus normally hang downwardly from guide 23' and with the length of rope 22 having been predetermined so that when awning A is in inoperative or upwardly swung condition the loop forming portion as at 25 of rope 22 will be securely received upon a cleat 26 fixed to wall 7 as by a screw 27.

Thus, when it is desired to lower curtain 1 into shade-producing, operative condition one merely removes the doubled end 25 of rope 22 from cleat 26 and thereby frees awning A for downward swinging action of return arms 17, 17' through gravity and thence into operative position.

From the foregoing it wil be readily apparent that awning A is uniquely constructed of a plurality of cooperable components which are of sturdy construction so that the same may be easily and rapidly assembled in mounted position with respect to a window or other wall opening by the average unskilled home owner. A most critical feature of the present invention resides in the novel structure permitting the user to control the effective length of curtain 1. It will be observed that curtain 1 together with pocket p and the received elongated member r coacts with the slotted tubular section 3 of mounting strip 2 so as to be reliably and securably anchored. The lower forward portion of curtain 1 is rolled upon itself about member r' and then inserted into tube 10 through one end thereof so that the end extremity projects downwardly through opening 8'. By this unique structure the effective length of curtain 1 is readily adjusted as by appropriate locating of the portion for doubling about member r'. The lower end which extends downwardly from tube 10 is thus controlled to provide the extent of drape desired; it being recognized that this particular feature is one of choice and varies from individual to individual. However, by such adjustability curtain 1 may be suitably shortened as by severing a predetermined portion of the extending extremity. Thus by this adjustability the individual is freed of concern as to having to obtain an awning of predetermined extent which might necessitate numerous changes until one of the preferred character has been obtained or from having to utilize an awning of unsatisfactory extent.

Figure 9:
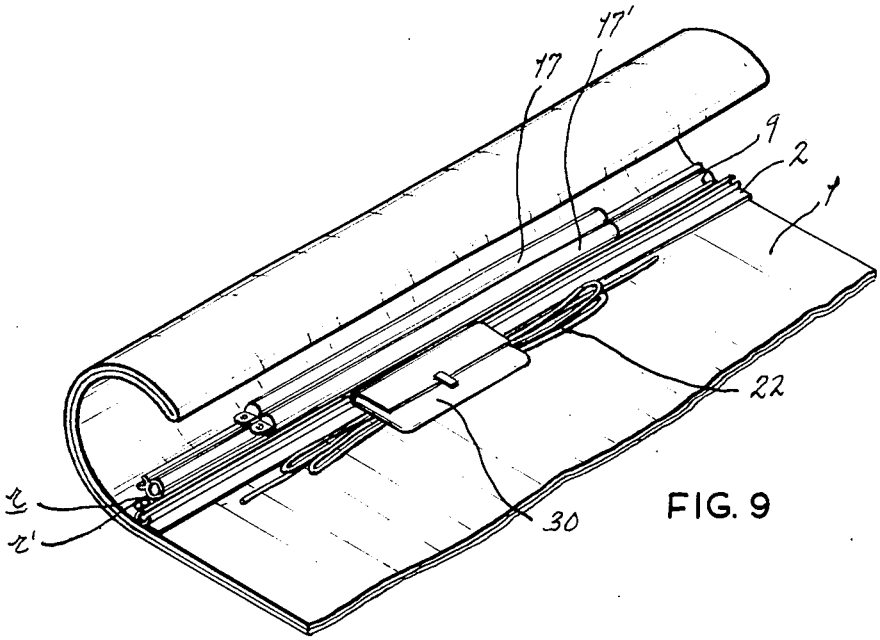
FIG. 9 is a perspective view illustrating the components of the awning construction of the present invention, demonstrating the same preparatory to being enclosed within the curtain for packaging.
Figure 10:
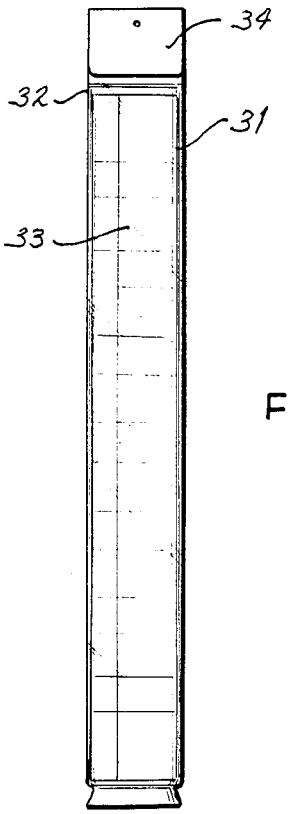
FIG. 10 is a side elevational view illustrating the awning construction in fully packaged state.

The present invention by reason of its novel character is especially suited for attractive and compact packaging. With reference now being made to FIG. 9 it will be seen that the hardware components and accessories such as return arms 17, 17', transverse arm 9, elongated members r, r', rope 22, and the cleats, hinges, screws and the like (which latter may be provided within a package as at 30) may be easily placed upon the folded curtain 1 which latter is then wound tightly about said components so as to form a roll as at 31. Said roll may then be inserted within a tubular casing 32 as formed of a clear transparent plastic 33 being permanently closed at one end and with the other end closable as by a suitable decorative element 34 which may bear a trademark and related matter in an artistic manner. Thus as so packaged, a purchaser merely will observe the design and color scheme of the curtain through the transparent casing 32. The structural components will, of course, all be hidden from view and thus not in any way detract from the pleasing appearance of the package.

What is claimed is:

1. A knock-down awning construction for treatment of a wall opening comprising a flexible curtain, an upper mounting strip, means securing said strip upon said wall upwardly of the opening to be treated, a lower transverse arm axially parallel to said mounting strip for disposition normally downwardly and outwardly thereof, means for engaging said wall for supporting said arm, means for retainingly securing the upper end portion of said curtain with said mounting strip, a tubular member integrally provided with said lower transverse arm and being axially parallel thereto, said tubular member having a downwardly directed co-extensive, slot-like opening, a rigid rod freely received within said tubular member and being axially parallel therewith, said rod being substantially co-extensive with said tubular member, said rod being normally urged gravitationally downwardly toward said slot-like opening, said rod further having a cross-section less than the inside cross-section of said tubular member for normally developing a void therebetween, the lower end portion of said curtain being directed upwardly through said slot-like opening into the said void within said tubular member and extending coveringly about said rod, and then being directed returningly downwardly and outwardly through said slot-like opening whereby the extremity of said lower end portion depends downwardly of said opening in exposed state, said curtain being relatively adjustably movable with respect to said rod to permit exposure of a preselected extent of said extremity, the combined cross-section of said rod and the thickness of the curtain portions trained about said rod within said tubular member is greater than the width of the slot-like opening in said tubular member but slightly less than the inside cross-section of said tubular member whereby said rod is upwardly shiftable but normally, through gravity, causes the lower surrounding portions of said curtain to be frictionally maintained against the slot-like opening adjacent inner portions of the tubular member in preselected condition.

2. A knock-down awning packaging comprising an awning curtain, as defined in claim 1, having a predetermined decorative pattern provided thereon, disassembled hardware components for mounting said awning in operative state, said curtain being in rolled form about said hardware components, said components being of such size and length as to be obscured from view when disposed within the rolled curtain, the decorative pattern of said curtain being exposed when said curtain is in rolled state, a transparent tubular casing having an inside diameter slightly greater than the outside diameter of the rolled, hardware-containing curtain, said casing being closed at one end and normally open at the other, said rolled, hardware-containing curtain being received within said casing with said decorative pattern being visible through said casing by reason of the transparency thereof to provide an appealing appearance and means for closing the upper end of said casing, by reason of the particular size and length of the hardware components the inclusion of the same within the rolled curtain is not manifest to the viewer from the exterior of said casing.

* * * * *